US008234992B1

(12) United States Patent
Patterson, Jr.

(10) Patent No.: US 8,234,992 B1
(45) Date of Patent: Aug. 7, 2012

(54) LAUNCH AND RECOVERY SYSTEM

(75) Inventor: William L. Patterson, Jr., Panama City, FL (US)

(73) Assignee: Lockheed Martin Corporation, Bethesda, MD (US)

( * ) Notice: Subject to any disclaimer, the term of this patent is extended or adjusted under 35 U.S.C. 154(b) by 184 days.

(21) Appl. No.: 12/770,314

(22) Filed: Apr. 29, 2010

(51) Int. Cl.
*B63B 35/40* (2006.01)

(52) U.S. Cl. ..... 114/259

(58) Field of Classification Search ..... 114/362, 114/258, 259, 262
See application file for complete search history.

(56) References Cited

U.S. PATENT DOCUMENTS

| | | | | |
|---|---|---|---|---|
| 2,398,274 | A | 4/1946 | Albert | |
| 3,448,712 | A * | 6/1969 | Lehmann et al. | 114/259 |
| 3,943,875 | A | 3/1976 | Sanders | |
| 4,697,533 | A | 10/1987 | Bordreuil et al. | |
| 4,876,979 | A | 10/1989 | Walton et al. | |
| 5,615,630 | A | 4/1997 | Eronen et al. | |
| 6,138,605 | A | 10/2000 | O'Brien | |
| 6,178,914 | B1 | 1/2001 | Axelsson | |
| 6,840,188 | B1 | 1/2005 | Witbeck | |
| 6,843,198 | B1 | 1/2005 | Witbeck | |
| 6,883,453 | B1 | 4/2005 | Mulhern | |
| 7,156,036 | B2 | 1/2007 | Seiple | |
| 7,162,969 | B2 * | 1/2007 | Houlder et al. | 114/362 |
| 7,506,606 | B2 | 3/2009 | Murphy et al. | |
| 7,581,507 | B2 * | 9/2009 | Kern | 114/259 |
| 2005/0160962 | A1 * | 7/2005 | Wright | 114/362 |

OTHER PUBLICATIONS

Brochure: "Stern Ramp Interface System", Michigan Aerospace Inc., available on-line at: "http://www.michiganaero.com/pdfs/alars_brochure.pdf", last updated Jun. 16, 2008.

* cited by examiner

*Primary Examiner* — Stephen Avila
(74) *Attorney, Agent, or Firm* — Howard IP Law Group, PC

(57) ABSTRACT

A system for facilitating launch and recovery of a multiplicity of different surface and subsurface craft from a host ship includes a notched stern assembly configured to engage an outer plat that is moveable in and out of the notch to provide a ramp for receiving a surface craft at a location spaced a distance behind the ship. The outer plat may decouple from the stern assembly. The outer plat and craft are drawn up into the notched stern assembly via a roller-guideway arrangement. An inner plat may also be provided for engaging subsurface craft. The inner plat may be separable from the outer plat, or may be connected to the outer plat. The inner plat may be independently powered to engage remote craft. Remote refueling, rearming and data downloading operations may be performed. The inner plat may nest with the outer plat within notched stern assembly when idle.

21 Claims, 10 Drawing Sheets

LAUNCH AND RECOVERY SYSTEM

FIELD OF THE INVENTION

The invention relates generally to systems for launching and recovering watercraft from ships, and more particularly to a system for providing an articulated platform for launching and recovering surface and subsurface craft from a ship.

BACKGROUND OF THE INVENTION

Currently, unmanned craft handling systems are single-point solutions designed to handle a single, specific payload. Given that unmanned craft to date have generally been single-point solutions as well, this situation has been acceptable from an operational standpoint. With the Navy's growing interest in operating multiple, heterogeneous craft from small surface combatants like the Littoral Combat Ship, single-point solutions are no longer acceptable.

In addition, current methods of directly launching and retrieving surface craft from a stern ramp requires a crew-intensive operation. This can be hazardous or impossible in high sea states or at forward speeds higher than 1-2 knots due to the risk of collision and damage to the craft or the host ship, or injury to crew members. Centering craft in a stern ramp opening of the host ship can be difficult in waves or propulsion wash from the host ship. In some cases, a towline loop can be thrown out behind the ship, but this requires additional handlers to secure the towline from the incoming craft.

Thus, there is a need for a common launch, recovery and support system for surface and subsurface maritime craft that is safe, adaptable and offers a "low-impact" approach to accommodating future craft as they are introduced to the fleet.

SUMMARY OF THE INVENTION

The disclosed system provides a common launch, recovery and support arrangement having improved load control and stability. The disclosed system increases separation between ship and target craft during critical phases of launch and recovery, which enhances safety both to the crew and the equipment. The system is also modular in nature so as to decouple primary launch and recovery elements from the ship's structure, which can enable a plurality of different recovery elements to be used with the same host ship. Thus, the system can be easily modified and/or improved without requiring substantial modifications to the host ship. The system may incorporate the functionality, such as guidance and propulsion systems, that can be used to rendezvous and dock with craft at over-the-horizon ranges from the host ship. This feature is valuable as an enabler for remotely refueling/servicing unmanned craft.

A launch and recovery system is disclosed. The system may comprise a first plat having first and second longitudinal members and at least one lateral support member connected to the first and second longitudinal members. Each of the first and second longitudinal members may have a roller disposed at a first end thereof. First and second guideways may be laterally spaced apart from said first and second longitudinal members, respectively. Each of the first and second guideways may be configured to receive one of the rollers of the first plat, and the first and second guideways may be connected to opposing faces of a notched stern assembly of a host ship.

A launch and recovery system is disclosed. The system may comprise a first plat having first and second longitudinal members and at least one lateral support member connected to the first and second longitudinal members. Each of the first and second longitudinal members may further have a roller disposed at a first end thereof, and first and second guideways laterally spaced apart from the first and second longitudinal members, respectively. Each of the first and second guideways may be configured to receive one of the rollers of the first plat. The first and second guideways may be connected to opposing faces of a stern of a host ship. The first plat may be configured to receive a water-borne surface vehicle and to bring the vehicle into engagement with the stern of the host ship.

DESCRIPTION OF THE DRAWINGS

The details of the invention, both as to its structure and operation, may be obtained by a review of the accompanying drawings, in which like reference numerals refer to like parts, and in which.

DETAILED DESCRIPTION

Figure 1A:
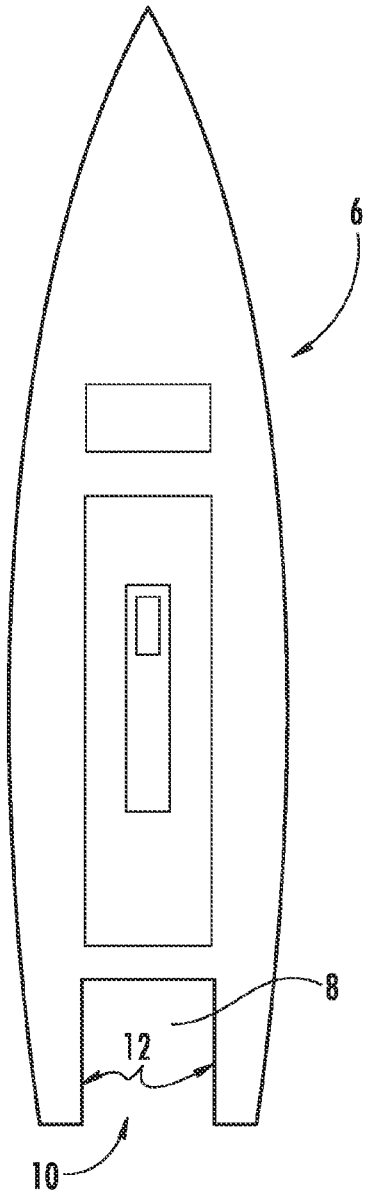
FIGS. 1*a* and 1*b* are top plan and side views of an exemplary host ship for use with the disclosed system.

In the accompanying drawings, like items are indicated by like reference numerals. This description of the preferred embodiments is intended to be read in connection with the accompanying drawings, which are to be considered part of the entire written description of this invention. In the description, relative terms such as "lower," "upper," "horizontal," "vertical,", "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description and do not require that the apparatus be constructed or operated in a particular orientation. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise.

The disclosed system provides a quick and efficient way to launch and recover manned and unmanned craft from a host ship. In one embodiment, nested, extensible platforms may be stowed in a notch in the stern of the host ship. During launch/ recovery evolutions, one or both of the platforms may be extended into the water to launch or recover the craft.

Figure 1B:
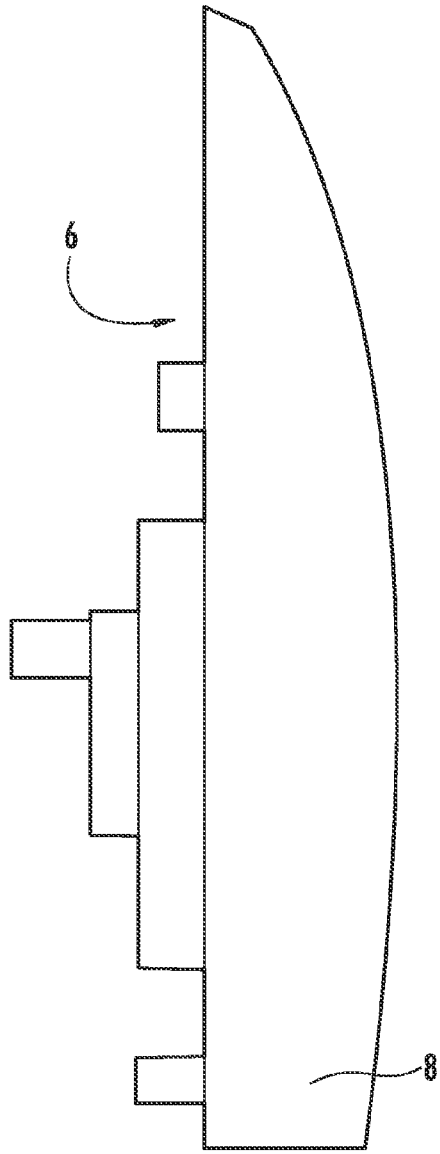
Figure 2:
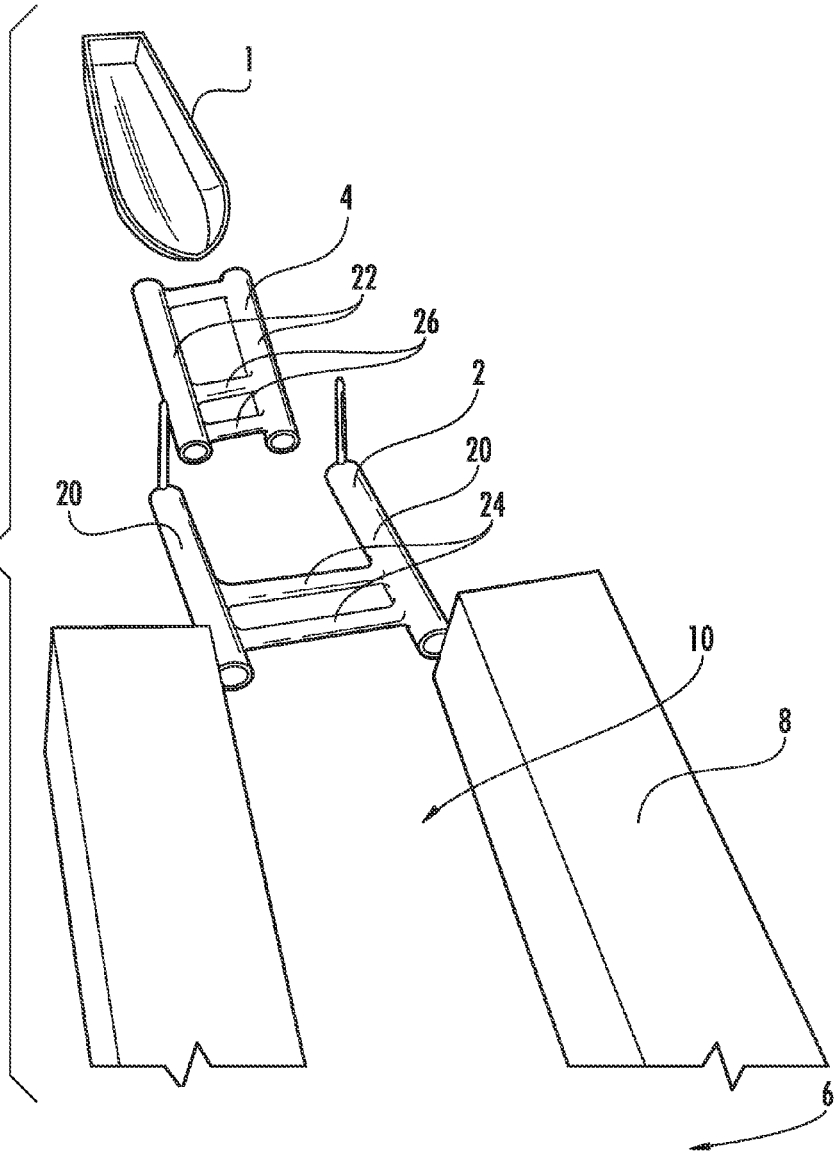
FIG. 2 is a perspective view of the disclosed launch and recovery system.

Referring to FIGS. 1 and 2, the system 1 may comprise and outer plat 2 and an inner plat 4. The outer plat 2 may be connected to a host ship 6 via a notched stern assembly 8. The notched stern assembly 8 is either an existing feature of the host ship 6, or it may be a separate assembly that is attached to, or built into, the stern of the ship's structure. In one embodiment, the outer plat 2 is slidably received within the notched stern assembly 8, and the inner plat 4 is slidably received within the outer plat 2. In another embodiment, the inner plat 4 is releasably connected to the outer plat 2 to enable the inner plat 4 to be disconnected from the outer plat as desired.

Figure 3:
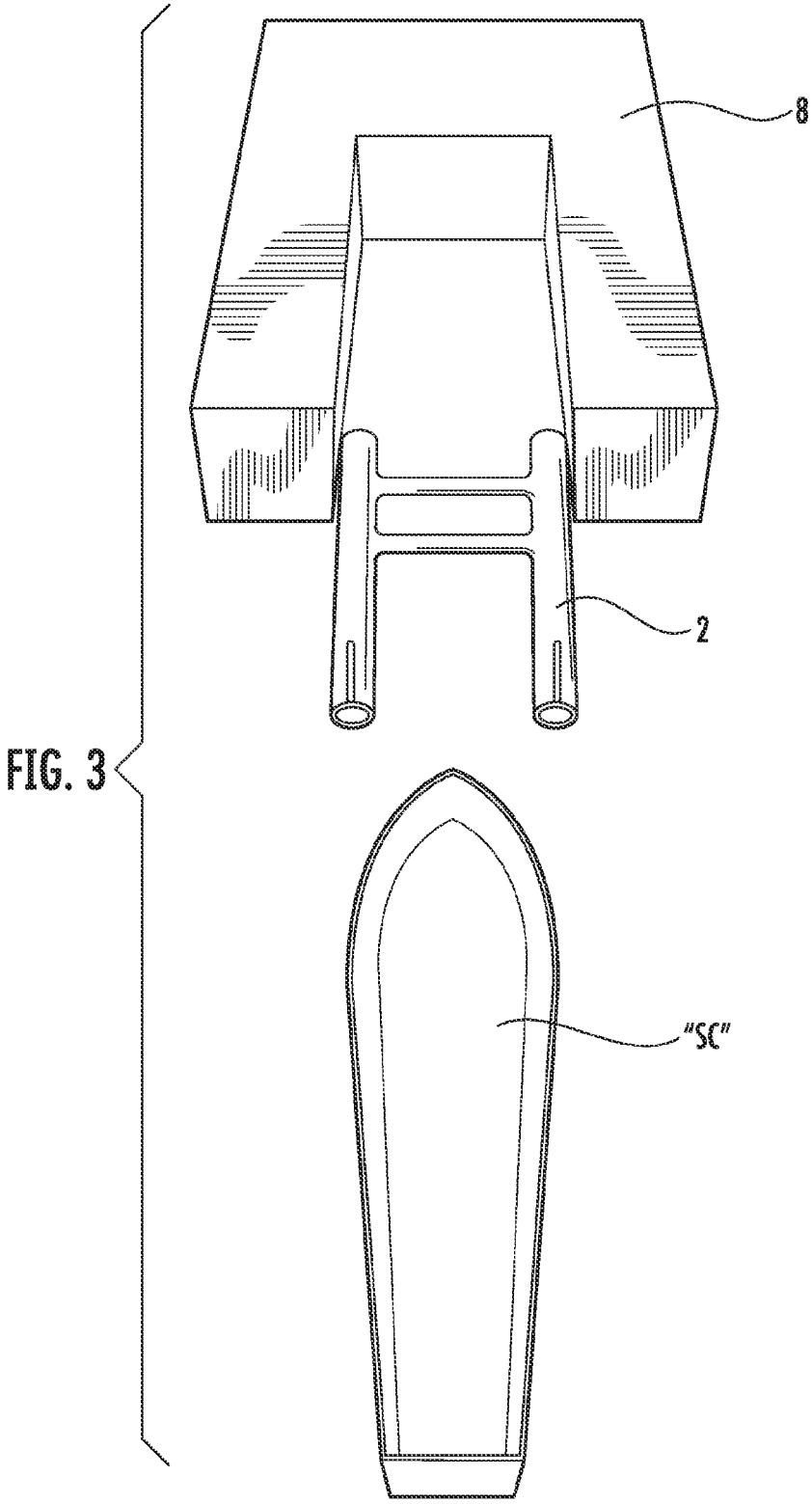
FIG. 3 is a perspective view of the system of FIG. 2 showing an exemplary surface craft approaching the system.

The outer and inner plats 2, 4 can be retracted within the notched stern assembly 8 when the system 1 is not in use, and can be extended into the water as desired to facilitate launch or recovery operations. An appropriate shipboard control system (not shown) may be used to control extension/retraction of the plats 2, 4, with respect to each other and with respect to the host ship 6. In general, the inner plat 4 may be configured for use as an interface for launch/recovery of subsurface craft "SSC" (see FIGS. 6-8), while the outer plat 2 may serve as a ramp for surface craft "SC" (see FIGS. 3-5).

Figure 8:
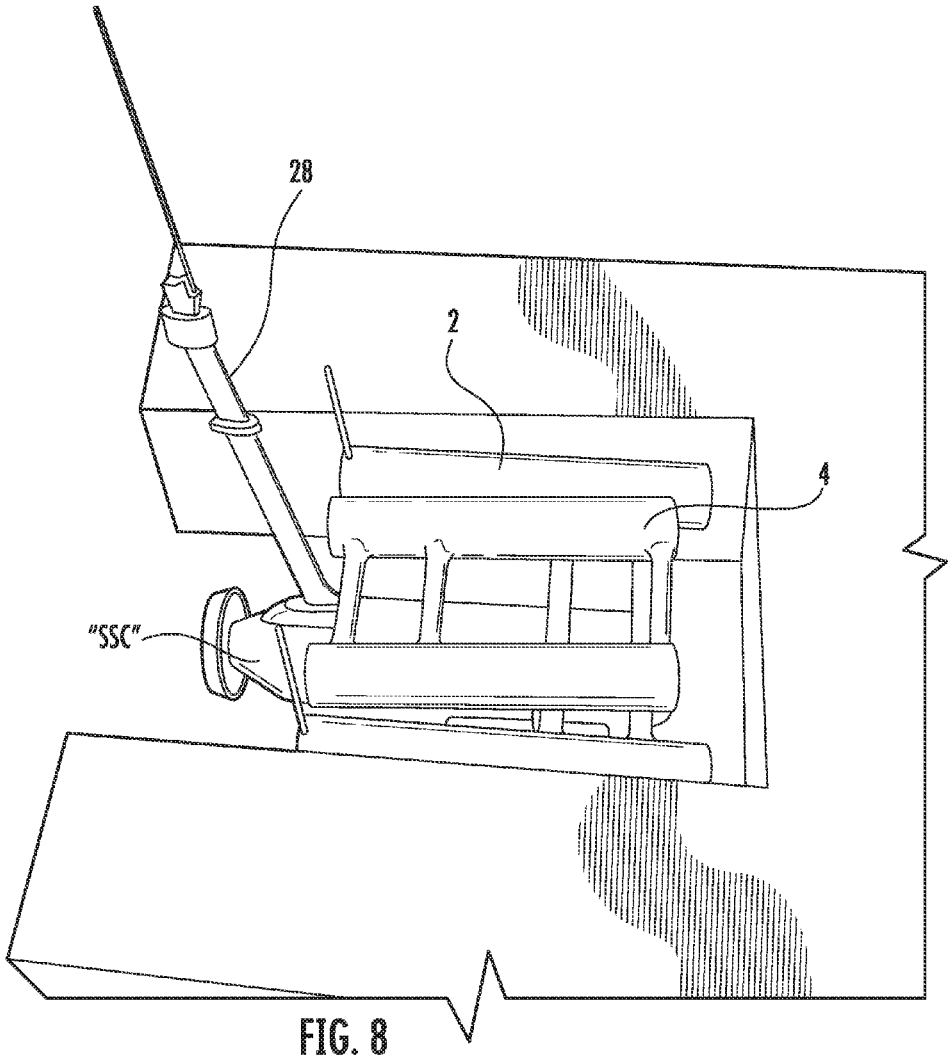
FIG. 8 is a perspective view of the system of FIG. 2 showing the subsurface craft received in the notched stern of the host ship.

In the illustrated embodiments the outer and inner plats 2, 4 are sized so they can nest together when retracted (see FIG. 8). This enables them to be stowed in, and deployed from, the notched stern assembly 8. The notched stern assembly 8 may consist of a generally rectangular opening 10 sized to receive the outer and inner plats 2, 4 when the two are in the retracted position. Although not shown in the figures a hatch may be provided to cover the opening 10 when the system 1 is in the stowed position to allow the deck space overlying the opening 10 to be used.

It should be noted that although the plats 2, 4 are illustrated as nesting together, it is contemplated that only the outer plat might be stowed in the notched stern assembly 8, while the inner plat is detached and stowed separately apart from the outer plat. The inner plat could then be stowed at any convenient location aboard the host ship. Such an embodiment may support the addition of propulsion and guidance systems on the inner plat 4 to enable the inner plat to disengage from the host ship 6 and remotely recover or otherwise service one or more subsurface craft.

Figure 4A:
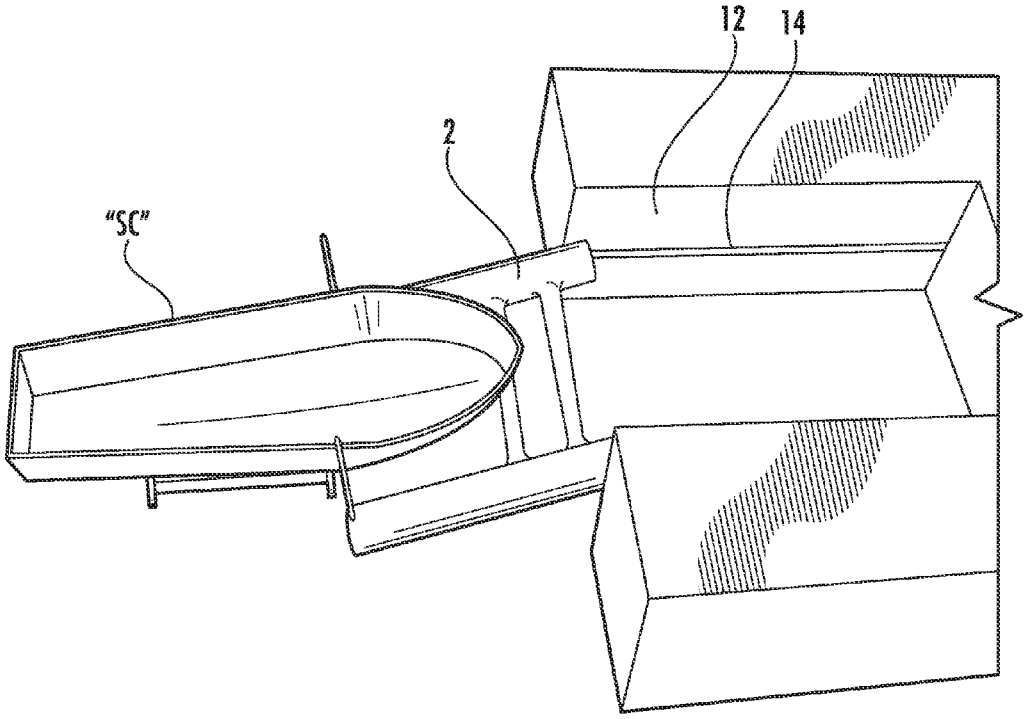
FIG. 4*a* is a perspective view of the system of FIG. 2 showing the surface craft engaging a first plat of the system.
Figure 4B:
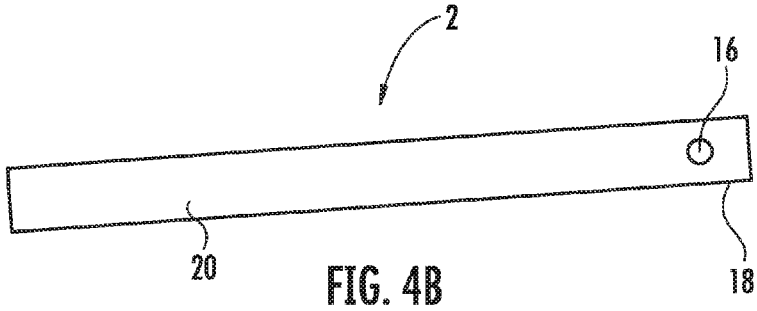
FIGS. 4*b*, 4*c* and 4*d* are side views of embodiments of a guideway arrangement for engaging the first plat of the system to the notched stern assembly of a surface craft.

In one embodiment, movement of the outer plat 2 with respect to the notched stern assembly 8 is via a guideway/roller arrangement. Referring to FIG. 4*a*, the opposed inner surfaces 12 of the notched stern assembly 8 (i.e., those that form the opening 10), may each have a guideway 14 disposed in or on the surface 12. The guideways 14 may be oriented generally parallel to the fore/aft direction of the ship. The guideways 14 can be sized to receive rollers 16 (FIG. 4*b*) or other bearing elements positioned at or adjacent to a forward end 18 of the outer plat 2. Thus, with the rollers 16 positioned within the respective guideways 14, the outer plat 2 can be slid into and out of the notched stern assembly 8 as desired during operation. The rollers may be any of a variety of well known roller elements, including wheels, balls, and the like. In one embodiment, the rollers include rubber tires to provide a desired degree of shock absorption.

Where the outer plat 2 is captive with respect to the notched stern assembly 8, the guideways 14 may have a stop member 15 (FIG. 4*c*) positioned near the aft end 17 of each of the guideways 14 to prevent the outer plat 2 from disconnecting from the stern of the host ship 6. In some cases, however, it may be desirable to enable the outer plat 2 to disconnect from the stern assembly 8, to enable capture of a surface craft at a location spaced some distance behind the host ship 6. As previously noted, this may be an advantage because it decouples the motion of the host ship 6 from the motion of the craft being captured (or released), which can result in a safer operation for crew and equipment. Where such decoupling is desired, the aft ends 17 of the guideways 14 may have a bell mouth configuration such that the aft ends 17 are wider than the forward ends 19. Such a configuration enables the rollers 16 to more easily find the guideways 14 when the outer plat 2 is attempting to engage the stern assembly 8 during craft recovery.

Figure 4C:
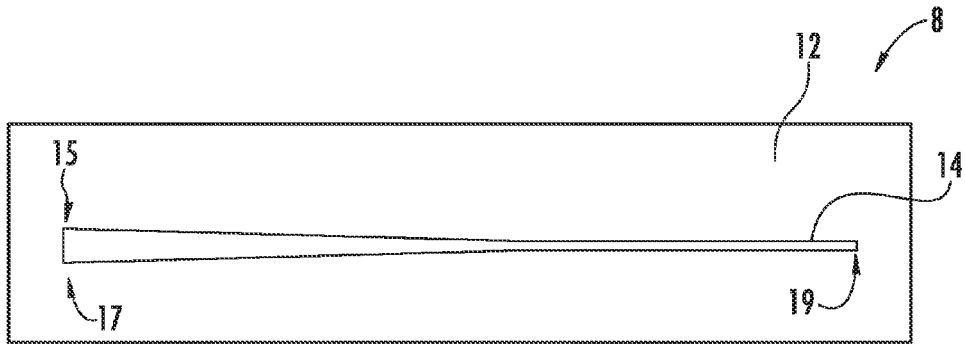
Figure 4D:
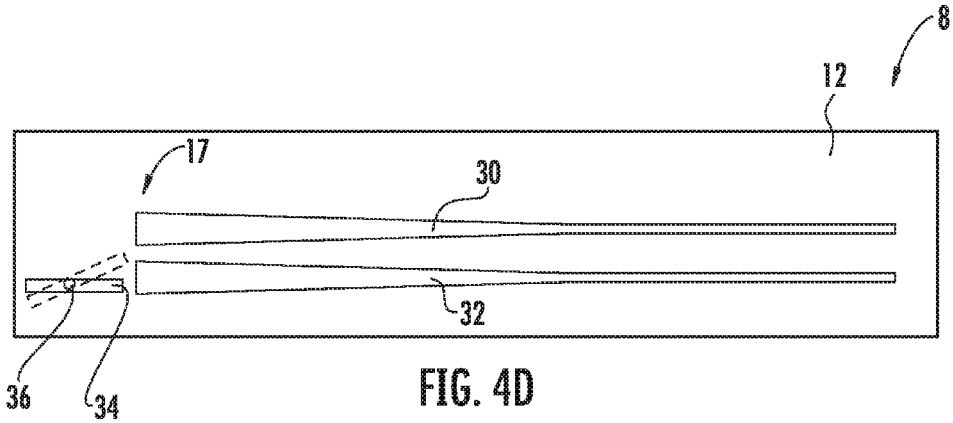

In addition to the bell mouth configuration, the guideways 14 may have a generally tapered configuration, as shown in FIG. 4*c*, in which the guideways are wider at their aft end 18 than at their forward end 10. This configuration allows some "slop" between the guideways and the rollers when the outer plat 2 is fully extended. Such "slop" is advantageous because it enables the outer plat 2 to undertake a wider range of motion with respect to the host ship 6 during the early engagement process, thus accommodating the disparate affects on the plat and the ship due to the forces of the sea. This arrangement reduces the overall bending and torsional forces on the outer plat during operation. As the outer plat 2 is drawn up the guideways 14, however, this "slop" is reduced, so that as the guideways neck-down, the outer plat 2 becomes more tightly connected to the notched stern assembly 8 until the two are firmly locked together. In the embodiment of FIG. 4*c*, only about one-half of the length of the guideway 14 (the aft half) is tapered. This is only an example, however, and it will be appreciated that the entire guideway may be tapered. Alternatively, it is also contemplated that the guideway not be tapered, and that relative motion between the outer plat 2 and the host ship 6 may be accommodated by an elastic or damped connection between the guideways and the notched stern assembly 8.

As previously noted, the inner plat 4 may remain captive with respect to the outer plat 2 or it may be separated to enable remote recovery and/or servicing of one or more unmanned craft. Thus the inner plat 4 may engage/disengage the outer plat 2 using a guideway/roller arrangement having some or all of the features described for connecting the outer plat 2 to the notched stern assembly 8.

As shown in FIG. 2, the plats may have a "ladder" like configuration in which a pair of longitudinal members 20, 22 are connected, in parallel, to a pair of transverse members 24, 26. Such an arrangement provides the plats with good strength and stiffness. It will be appreciated that this is only one possible arrangement, however, and a variety of other structural configurations are contemplated for the inner and outer plats. For example, one or both of the plats 2, 4 may have a generally U-shaped configuration without rigid transverse members, and the longitudinal members may be connected using netting, or inflatable members. Further, the transverse members 24, 26 may themselves have a U-shape, V-shape, or other appropriate shape to cradle the craft being launched/recovered.

Thus, as described, the system 1 provides simplified interfaces, improved load path and improved craft control as compared to current arrangements. The disclosed system enables a craft to be captured before it is brought on board the ship. This is superior to current systems, which, in the case of the capture of surface craft, can require the craft operator to gun the engine and drive the craft directly into the notched stern of the host ship in a largely uncontrolled manner. The disclosed system 1 enables the payload to be stabilized and brought under control (i.e., engaged with the respective plat) before being brought on board the host ship 6, resulting in a safer recovery operation which reduces the chance of sustaining damage to the craft, host ship 6 or personnel. The disclosed multistage configuration also makes the system flexible to allow easy adaptation to a wide variety of current and future craft, without expensive modifications to the host ship.

Although the plats 2, 4 may be manufactured as rigid tubular members (as illustrated), they may take any cross-sectional shape (e.g., triangular, rectangular, flattened) desired. In addition, the plats may be manufactured from any of a variety of materials appropriate for sustaining the loads experienced in use, and which are suitable for use in marine environments. A non-limiting list of such materials includes metals such as steel and aluminum, and non-metals such as fiberglass and other composite materials.

In addition, one or more of the longitudinal and/or transverse members may be inflatable (using air, water, or a combination of both) to provide a soft surface for interfacing with an associated craft, as well as to control the depth of the associated plat 2, 4 in the water. Such depth control may be advantageous because it can allow the system 1 to accommodate craft having different drafts, different heights above the water, and different hull shapes. In addition, or alternatively, one or both of the plats may incorporate sub-surface fins for steering, and for controlling height and angle of the plat in the water to accommodate the previously noted features.

To provide a degree of control over the elevation of the outer plat 2 with respect to the notched stern assembly 8, a pair of parallel guideways may be provided in lieu of the single guideway set shown in FIG. 4*c*. Thus, referring to FIG. 4*d*, upper and lower guideways 30, 32 may be provided on the opposed inner surfaces 12 of the notched stern assembly 8. Movable shuttles 34 (FIG. 4*d*) may be positioned at the aft end 17 of the guideways 30, 32. These shuttles 34 may comprise a controllable pivot member 36 that acts like a railroad switch to guide the outer plat 2 into the upper guideways 30 or the lower guideways 32. The solid outline of shuttle 34 is shown in position to direct the outer plat 2 into the lower guideways 32, while the dashed outline of shuttle 34 is shown in position to direct the outer plat 2 into the upper guideways 34. The lower guideways 32 may be used when recovering a boat-like vehicle in which the bulk of the vehicle is located above the waterline, while the upper guideways 30 may be used when recovering a vehicle (e.g., a remote mine hunting vehicle) in which the bulk of the vehicle is located below the waterline. The upper and lower guideways 30, 32 may have some or all of the same features as described in relation to the guideways 14 described in relation to FIGS. 4*a*-4*c*.

In one embodiment, the inner plat 4 may be customized to interface with a particular type of subsurface craft (e.g., a Swimmer Delivery Vehicle, remote mine hunting vehicle). With such a design, a plurality of inner plats 4 may interface with a single common outer plat 2 and/or the host ship 6 to provide a more robust system that minimizes or eliminates changes to the host ship structure.

As previously noted, the inner plat 4 may be completely separable from the outer plat 2 and the host 6. In one embodiment, the inner plat 4 may be further configured to function as a remote recovery and/or support craft to enable the system to service craft that are positioned remote from the host ship 6 (e.g., over the horizon). In such embodiments, the inner plat 4 may include an onboard propulsion system (e.g., outboard motor(s), inboard engines, diesel-electric drives, and the like), as well as a guidance system to enable the inner plat 4 to be navigated to a remotely positioned craft. To facilitate rendezvous with a remote craft, the inner plat 4 may be fit with multi-spectral sensing equipment such as infrared and visual cameras, imaging scanning lasers, and the like to enable the inner plat 4 to recognize the shape of the targeted craft and adjust the position or heading of the plat 4 accordingly. In one embodiment, the remote craft is fit with a homing beacon (e.g., optical or acoustic) to enable the plat 4 to locate the craft.

Additional remote operations can be accommodated by fitting the plat 4 with an charging system, a data link, and a refueling probe. In one embodiment, the charging system may include an inductive charger. Further, when the plat 4 includes a refueling probe, the plat 4 may also have onboard tanks or a towed bladder/bowser for storing fuel. Additional features such as wireless data transfer and retransmit systems (for offloading data obtained by one or more sensors on the craft), may be provided, as well as recovery aids such as on-board cameras, wireless communications, and the like.

To further facilitate remote operations, the inner plat 4 may be fitted with one or more cameras to enable personnel on the host ship 6 to view and/or control the plat 4 to enable it to approach and/or dock with the remote craft.

Where the inner plat 4 is configured to retrieve a submersible craft having a snorkel mask 28, the transverse members 26 may be configured to rotate or fold out to avoid interfering with the mast as the craft slides into contact with the plat. In addition, the inner plat 4 may include an arm (not shown) for lowering the mast before engaging the host ship 6 to ensure that the mast does not interfere with the ship's structure. The plat 4 may also be fitted with an inflatable seal for engaging the base of the mast, when lowered, thereby preventing ingress of water into the exhaust structure.

As disclosed, the system 1 is flexible enough to support side port operations, in which a side door (rather than a stern notch) on the host ship 6 can be used for launch/recovery operations. Such side port operations are possible if the inner plat is powered, so that it can then be commanded to bring a recovered craft adjacent to the side port of the host ship 6 for on-loading (or, correspondingly, for off-loading).

One or more cameras can also be provided adjacent to, or on, the inner and outer plats 4, 2 to enable ship's personnel to view the components as they function. Such cameras may facilitate initial engagement of a craft with its respective plat (particularly for remote engagement of a craft using a powered version of the inner plat 4). The implementation of rendezvous and docking cameras can thereby reduce operator workload. Further, the rendezvous and docking evolution can be partially or fully automated in order to further reduce operator workload.

The system 1 may include active and/or passive restraint systems. Thus, the notched stern assembly may include one or more winches for engaging and manipulating the position of the outer plat 2 in the opening 10 of the notched stern assembly 8. Likewise, the outer plat 2 may include one or more winches for engaging and manipulating the position of the inner plat 4 with respect to the outer plat 2. It will be appreciated that other arrangements for moving the plats can be used in lieu of winches, including, for example, geared drives, linear actuators, and the like.

Active and/or passive restraints may be used to engage a craft with an associated inner or outer plat. A non-limiting list of exemplary passive restraints include tow nets, docking collars, and nets hung across the longitudinal/transverse members 20-26 of the respective plats 2, 4. A non-limiting list of exemplary active restraints include robotic arms, and automatic locking tabs, hooks or plates for capturing the craft once it is moved into position with respect to the plat. Winches, geared drives, linear actuators, or the like, may be used to cinch a captured craft to its plat.

As will be appreciated, the disclosed system can be easily modified to accommodate new and different payloads independent of the structure of the host ship, thereby reducing overall life cycle costs. The system is able to support remote refuel/rearm of unmanned craft, which enables servicing of such craft at increased standoff from the host ship. The system results in enhanced safety due to improved load control and improved interface with the craft being handled. It can also result in reduced manning, and in some embodiments it supports fully automated launch and recovery of craft.

Figure 5:
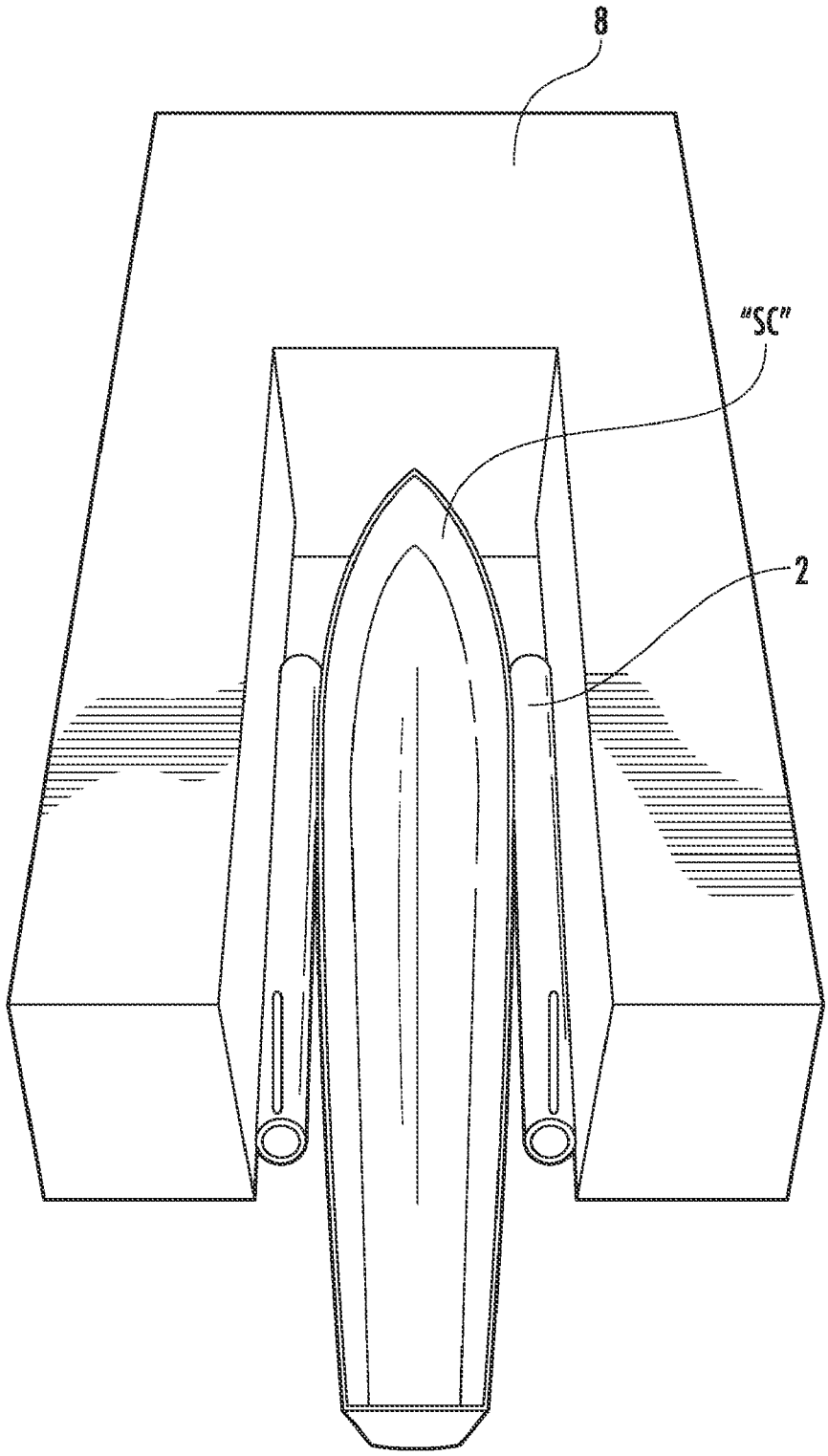
FIG. 5 is a perspective view of the system of FIG. 2 showing the surface craft received in the notched stern of the host ship.

In operation, to recover a surface craft "SV" (FIG. 3), the outer plat 2 is extended away from the notched stern assembly 8 so that it extends into the water at the stern of the host ship 6. In some cases, the inner plat 4 is disconnected from the outer plat (if the two were connected) and stowed separately. The surface craft is driven up into engagement with the outer plat 2 as shown in FIG. 4*a*. Although not shown, the surface craft may fixed to the outer plat 2 via a hook and/or net arrangement. Further, one or more winches, geared drives, linear actuators, or the like, disposed on the plat 2 may be used to secure the craft to the plat before the two are drawn up into engagement with the notched stern assembly 8. For embodiments in which the outer plat 2 is completely disengaged from the guideways 14 for initial capture of the surface craft, outer plat 2 is drawn toward the notched stern assembly 8 so that the rollers 16 of the outer plat 2 are aligned with and engage the aft ends 17 of the guideways 14. When the rollers 16 are received in the guideways 14, movement of the plat 2 and craft proceeds until the two are fully received within the notched stern assembly 8, as shown in FIG. 5. Launching the surface vessel is accomplished by performing the aforementioned steps in reverse order.

Figure 6:
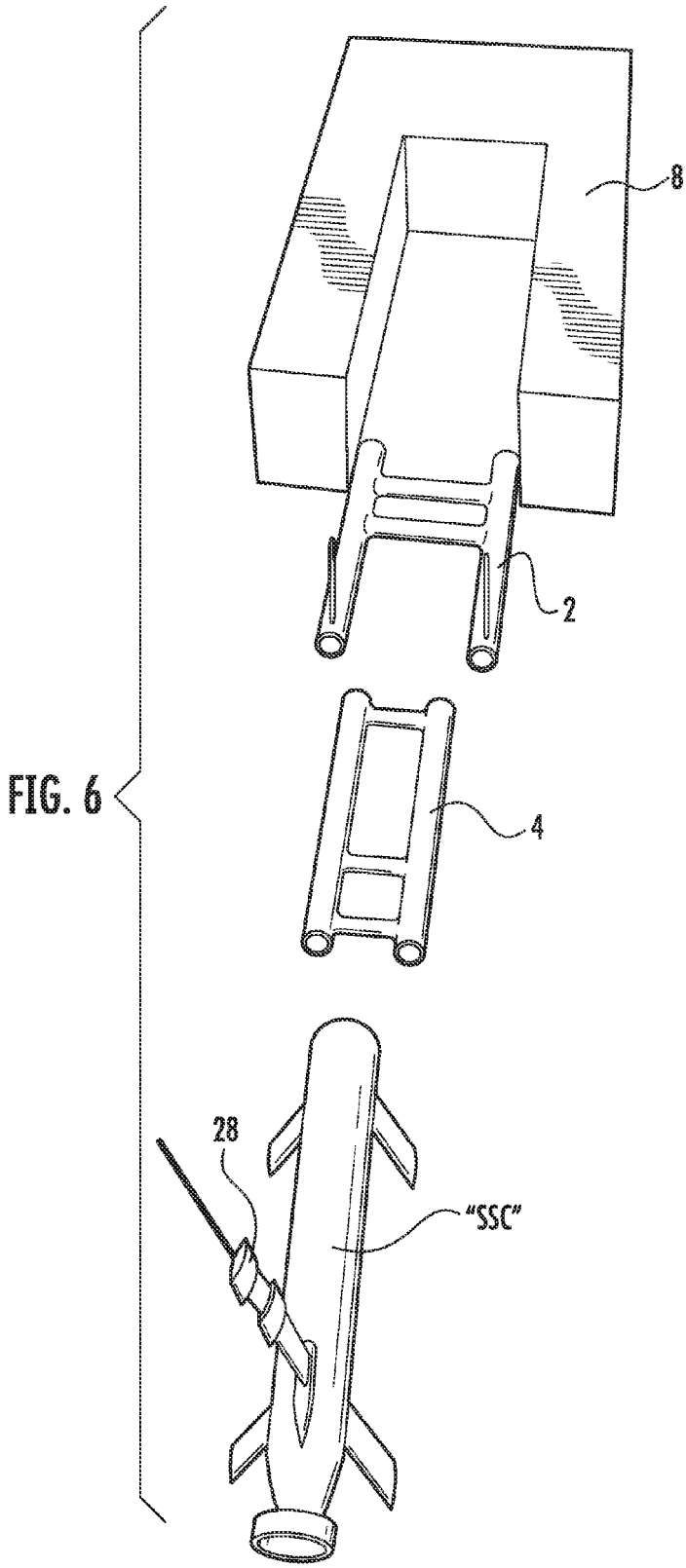
FIG. 6 is a perspective view of the system of FIG. 2 showing an exemplary subsurface craft approaching the system.
Figure 7:
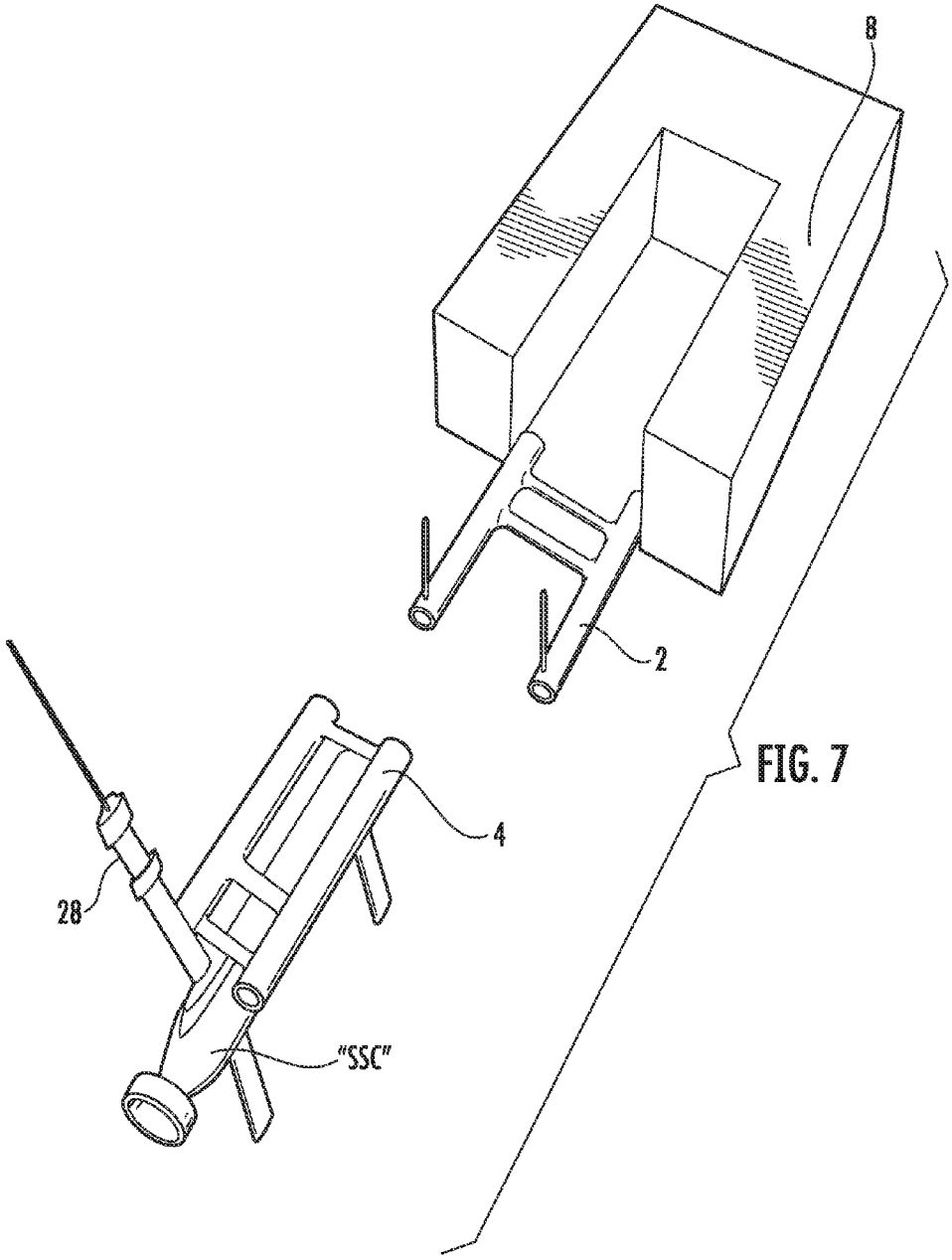
FIG. 7 is a perspective view of the system of FIG. 2 showing the subsurface craft engaging a second plat of the system.

To recover a subsurface craft, the inner plat 4 is extended away from the outer plat 2 and the notched stern assembly 8 so that it is positioned in the water off the stern of the host ship 6 (see FIG. 6). The inner plat 4 engages the subsurface craft, under power of either the craft or the plat 4, to achieve the configuration shown in FIG. 7. Although not shown, the subsurface craft may fixed to the inner plat 4 via a hook and/or net arrangement. Further, one or more winches, geared drives, linear actuators, or the like, disposed on the plat 4 may be used to secure the craft to the plat before the two are drawn up into engagement with the outer plat 2. The inner plat 4, with the subsurface craft engaged, engages the outer plat 4, and the resulting assembly is drawn up into the notched stern assembly 8 using the steps previously described for recovering a surface craft. Launching the subsurface craft would be accomplished by performing the aforementioned steps in reverse order.

Remote recovery of a subsurface craft would occur in the same manner, except that the step of engaging the inner plat 4 with the subsurface craft would occur a remote distance from the host ship. The inner plat 4 and the subsurface craft would travel together back to the host ship to engage the outer plat 2.

The system may be further (or alternatively) configured to enable remote recovery of a surface craft using an arrangement that is the same or similar to the remote recovery arrangement described above in relation to subsurface craft.

It will be appreciated that although the system has been described for use with multiple plats 2, 4, the system could use only a single plat. In one embodiment, only the outer plat 2 would be provided. In another embodiment, only the inner plat 4 would be provided. In such an embodiment the inner plat 4 would interface directly with the notched stern assembly 8 in the manner described in relation to the outer plat (i.e., rollers/guideways) A system employing a single plat would include some or all of the features previously described in relation to the outer and inner plats 2, 4. It one embodiment, the single plat would be little more than a boat ramp that can slide out from the notch in the host ship. In more complex forms, the plat may be capable of launching from the host ship, navigating to a target, recovering the target, and returning the payload to the host ship.

Although the invention has been described in terms of exemplary embodiments, it is not limited thereto. Rather, the appended claims should be construed broadly, to include other variants and embodiments of the invention, which may be made by those skilled in the art without departing from the scope and range of equivalents of the invention.

What is claimed is:

1. A launch and recovery system, comprising:

a first plat having first and second longitudinal members and at least one lateral support member connected to the first and second longitudinal members, each of the first and second longitudinal members having a roller disposed at a first end thereof; and first and second guideways laterally spaced apart from said first and second longitudinal members, respectively, each of the first and second guideways configured to receive one of the rollers of the first plat;

wherein the first and second guideways are connected to opposing faces of a notched stern assembly of a host ship, and wherein each of the first and second guideways has a tapered geometry such that a clearance between the guideways and their respective rollers is greater at a first end of the guideways than at a second end of the guideways.

2. A launch and recovery system of comprising:

a first plat having first and second longitudinal members and at least one lateral support member connected to the first and second longitudinal members, each of the first and second longitudinal members having a roller disposed at a first end thereof; and first and second guideways laterally spaced apart from said first and second longitudinal members, respectively, each of the first and second guideways configured to receive one of the rollers of the first plat;

wherein the first and second guideways are connected to opposing faces of a notched stern assembly of a host ship;

a second plat having third and fourth longitudinal members and at least one lateral support member connected to the first and second longitudinal members, each of the first and second longitudinal members having a roller disposed at a first end thereof; and third and fourth guideways laterally spaced apart from said third and fourth longitudinal members, respectively, each of the third and fourth guideways configured to receive one of the rollers of the second plat;

wherein the third and fourth guideways are connected to the first and second longitudinal members of the first plat.

3. The launch and recovery system of claim 2, further comprising a winch, a geared drive or a linear actuator for moving the second plat with respect to the first plat along the third and fourth guideways.

4. The launch and recovery system of claim 2, wherein the second plat is detachable from the first plat, and the second plat further comprises a motor, a navigation system, and a communications system for communicating with at least one of a host ship and a remote vehicle.

5. The launch and recovery system of claim 1, further comprising a winch, a geared drive or a linear actuator for moving the first plat with respect to the host ship along the first and second guideways.

6. The launch and recovery system of claim 1, wherein at least one of the first and second longitudinal members and the lateral support member are inflatable.

7. The launch and recovery system of claim 1, wherein at least one of the first and second longitudinal members and the lateral support member are fillable with a fluid to adjust the buoyancy thereof.

8. The launch and recovery system of claim 1, wherein the first plat further comprises at least one fin for steering the first plat with respect to the host ship.

9. The launch and recovery system of claim 1, wherein the tapered geometry of each of the first and second guideways further comprises a bell mouth configuration at the first end.

10. A launch and recovery system, comprising:

a first plat having first and second longitudinal members and at least one lateral support member connected to the first and second longitudinal members, each of the first and second longitudinal members further having a roller disposed at a first end thereof; and first and second guideways laterally spaced apart from said first and second longitudinal members, respectively, each of the first and second guideways configured to receive one of the rollers of the first plat;

wherein the first and second guideways are connected to opposing faces of a stern of a host ship, and wherein each of the first and second guideways has a tapered geometry such that a clearance between the guideways and their respective rollers is greater at a first end of the guideways than at a second end of the guideways; and wherein the first plat is configured to receive a water-borne surface vehicle, and to bring the vehicle into engagement with the stern of the host ship.

11. A launch and recovery system comprising:

a first plat having first and second longitudinal members and at least one lateral support member connected to the first and second longitudinal members, each of the first and second longitudinal members further having a roller disposed at a first end thereof; and first and second guideways laterally spaced apart from said first and second longitudinal members, respectively, each of the first and second guideways configured to receive one of the rollers of the first plat;

wherein the first and second guideways are connected to opposing faces of a stern of a host;

wherein the first plat is configured to receive a water-borne surface vehicle, and to bring the vehicle into engagement with the stern of the host ship; and a second plat having third and fourth longitudinal members and at least one lateral support member connected to the first and second longitudinal members, the longitudinal members and lateral support member configured to engage a water-borne subsurface vehicle, each of the first and second longitudinal members further having a roller disposed at a first end thereof; and third and fourth guideways laterally spaced apart from said third and fourth longitudinal members, respectively, each of the third and fourth guideways configured to receive one of the rollers of the second plat;

wherein the third and fourth guideways are connected to the first and second longitudinal members of the first plat.

12. The launch and recovery system of claim 11, further comprising a winch, a geared drive or a linear actuator for moving the second plat with respect to the first plat along the third and fourth guideways.

13. The launch and recovery system of claim 11, wherein the second plat is detachable from the first plat, the second plat further comprising a motor to enable the second plat to rendezvous with a vehicle remote from the host ship.

14. The launch and recovery system of claim 13, wherein the second plat further comprises a navigation system, and a communications system for communicating with at least one of a host ship and a remote vehicle.

15. The launch and recovery system of claim 10, further comprising a winch, a geared drive or a linear actuator for moving the first plat with respect to the host ship.

16. The launch and recovery system of claim 10, wherein at least one of the first and second longitudinal members and the lateral support member are inflatable.

17. The launch and recovery system of claim 10, wherein at least one of the first and second longitudinal members and the lateral support member are fillable with a fluid to adjust the buoyancy thereof.

18. The launch and recovery system of claim 10, wherein the first plat further comprises at least one fin for steering the first plat with respect to the host ship.

19. The launch and recovery system of claim 10, wherein the tapered geometry of each of the first and second guideways further comprises a bell mouth configuration at the first end.

20. The launch and recovery system of claim 1, wherein said first plat is configured to be detachably coupled to said notched stern assembly.

21. The launch and recovery system of claim 20, further comprising a stop member disposed about an aft end of said first and second guideways for impeding detachment of said first plat from said notched stern assembly.

* * * * *